United States Patent [19]

Kimura et al.

[11] Patent Number: 4,824,362

[45] Date of Patent: Apr. 25, 1989

[54] METHOD FOR OPERATION OF FLASH SMELTING FURNACE

[75] Inventors: Takayoshi Kimura; Yasuo Ojima; Yoshiaki Mori, all of Niihama, Japan

[73] Assignee: Sumitomo Metal Mining Company Limited, Tokyo, Japan

[21] Appl. No.: 154,355

[22] Filed: Feb. 11, 1988

[30] Foreign Application Priority Data

Feb. 13, 1987 [JP] Japan ..... 62-30962

[51] Int. Cl.[4] ..... F27D 3/00; F27B 19/02

[52] U.S. Cl. ..... 432/13; 266/212; 266/227; 110/238; 432/210

[58] Field of Search ..... 432/197, 210, 160, 161; 110/238; 266/205, 212, 227, 232, 242

[56] References Cited

U.S. PATENT DOCUMENTS

| | | | |
|---|---|---|---|
| 3,353,807 | 11/1967 | Sikel et al. | 266/212 |
| 3,527,449 | 9/1970 | Worner | 266/232 |
| 3,901,489 | 8/1975 | Suzuki et al. | 266/227 |
| 3,975,228 | 8/1976 | Yasunaga et al. | 110/238 |
| 4,200,265 | 4/1980 | Berndt et al. | 266/212 |
| 4,226,406 | 10/1980 | Frolov et al. | 266/227 |
| 4,401,295 | 8/1983 | Yoshida | 266/227 |
| 4,457,777 | 7/1984 | MacGregor et al. | 266/212 |

*Primary Examiner*—Henry C. Yuen

*Attorney, Agent, or Firm*—Watson, Cole, Grindle & Watson

[57] ABSTRACT

A method of operating a flash smelting furnace which includes a reaction shaft, a concentrate burner disposed at the top of the reaction shaft, a settler disposed with one end thereof connected to the lower part of the reaction shaft, an uptake disposed as connected to the other end of the settler, and at least one lance pipe disposed through the ceiling of the settler between the reaction shaft and the uptake and adapted to permit forced supply of at least powdery raw materials and a reaction gas into the melt in the settler includes the steps of blowing the powdery raw materials containing only a small amount of incombustible substances and the reaction gas into the reaction shaft through the concentrate burner, blowing powdery raw materials containing at least incombustible substances through the lance pipe, and employing means capable of at least retaining the heat of the melt.

4 Claims, 4 Drawing Sheets

METHOD FOR OPERATION OF FLASH SMELTING FURNACE

BACKGROUND OF THE INVENTION

1. Field of the Invention

This invention relates to a method for the operation of a flash smelting furnace used for producing from copper or nickel sulfide ore the matte as a smelting intermediate for the corresponding metal, which method is particularly aimed at enhancing the ability of the furnace to accomplish the treatment.

2. Description of the Prior Art

A flash smelting furnace which uses sulfide concentrates as a raw material and which is called a "flash furnace" enjoys many advantages as compared with smelting furnaces of other types, and yet suffers from many disadvantages. For the sake of illustration, a conventional flash furnace for copper will be described with reference to FIG. 2.

In a flash smelting furnace 1, powdered concentrate 2 and reaction gas 3 such as preheated air are jointly blown into a reaction shaft 5 of the furnace through a concentrate burner 4 at the top of the furnace. Inside the reaction shaft 5, sulfur and iron which are combustible components of the powdered concentrate 2 react with the hot reaction gas 3 and melt themselves. The resulting melt is allowed to collect in a settler 6. In the settler, which serves as a reservoir for the melt, the melt is divided by virtue of differences in specific gravity into a matte 7 which is a mixture of $Cu_2S$ and FeS and a slag 8 which consists mainly of $2FeO.SiO_2$. The slag 8 is released through a slag discharge outlet 9 and introduced into an electric slag cleaning furnace 10. In the meantime, the matte 7 is tapped through a matte discharge outlet 11 in compliance with the demand from a converter which constitutes itself a next step of operation.

A hot waste gas 12 emanating meanwhile from the flash smelting furnace 1 is passed through the settler 6 and an uptake 13 and cooled in a boiler 14. The slag which has entered the electric slag smelting furnace 10 is kept heated with the heat generated by the heat fed in through electrodes 15 and, when necessary, mixed as with lumps of ore and flux introduced into the electric slag cleaning furnace 10, with the result that the copper component is further allowed to settle to the bottom of the furnace and the slag containing a barely remaining copper component is only released out of the system via an outlet 16.

The conventional flash smelting furnace has entailed many drawbacks as indicated below.

(1) Inside the reaction shaft 5, supplemental fuel is used to make up for insufficient calorific supply. Owing to the heat of reaction of the concentrate as the raw material and the heat of combustion of the supplemental fuel, the temperature of the atmosphere inside this reaction shaft 5 is elevated to a fairly high level. An attempt at increasing the amount of the concentrate to be treated results in an accelerated wear of the refractory bricks lining the reaction shaft 5 by fusion. Thus, amount of the concentrate to be forwarded through the concentrate burner 4 and treated per unit time is inevitably limited to an extent at which the wear of the bricks by fusion is tolerable. This wear of the bricks by fusion bears closely upon the thermal load of the reaction shaft. The wear occurs conspicuously if the thermal load exceeds 350,000 Kcal/m$^3$.hr. Thus, the thermal load is desired to be not more than 250,000 Kcal/m$^3$.hr.

An addition to the amount of treatment is realized by increasing the inside diameter and height of the reaction shaft. Since this dimensional increase inevitably entails an increase in the surface area of the reaction shaft, the amount of heat radiated is proportionately increased and, to make up for this loss of heat, the amount of supplemental fuel to be used is increased. Further, such an exclusive increase in the reaction shaft as considered here is fairly difficult to realize in an existing flash furnace.

As a means of permitting treatment of an increased amount of concentrate, a method which resorts to an increase in the oxygen content of the preheated air 3 or an increase in the degree of oxygen enrichment is conceivable. Again in this case, the atmosphere in the reaction shaft 5 suffers further elevation of temperature. From the standpoint of avoiding the loss of the lining refractory bricks by melting, therefore, the amount of concentrate to be treated has its own upper limit.

(2) In the concentrate burner 4, the powdery concentrate 2 and the reaction gas 3 are blown into the space of the reaction shaft 5. The melt consequently formed therein falls dropwise into the settler 6, where it is separated into the matte and the slag. The hot waste gas 12 from the flash furnace 1, therefore, contains a large amount of dust. This dust tends to accumulate in the uptake 13, in the part interconnecting the uptake 13 and a boiler 14, and inside the boiler 14, and forms an obstacle to the passage of gas.

Since this dust contains valuable metals, it is recovered at the boiler and an electrostatic precipitator and returned to the flash furnace 1 as entrained by the concentrate 2 being fed thereto. This dust, however, is in an oxidized or sulfated state because it has undergone an oxidation reaction in the atmosphere containing $SO_2$. When the dust is recycled in the reaction shaft 5, the amount of supplemental fuel required is increased and, moreover, the ignition and combustion of the concentrate is impeded by the absorption of heat due to the decomposition of the sulfate components, with the inevitable result that the portion of the concentrate escaping the combustion induces an increase in the amount of scattered dust and an increase in the amount of unmelted concentrate on the bath surface. This contradictory relation resembles what occurs in a powdery fire extinguisher which kills fire by the heat of its own decomposition. Further, the incombustible dust which has undergone a further oxidation reaction has such a high melting point that a large proportion thereof will be taken out of the furnace as entrained by the waste gas, giving rise to a vicious cycle of increasing the amount of dust to be produced.

Such incombustible raw materials as powdered residual copper which has an extremely low sulfur content is also treated in the reaction shaft 5. This treatment has the same problem as the treatment of the recovered dust.

(3) An attempt at increasing the amount of the concentrate to be treated in the concentrate burner 4 results in an increase in the ratio of dust generation described in (2) above because the space density and distribution of the concentrate and the flow rate of gas within the reaction shaft 5 are suffered to deviate from the optimum reaction conditions. From the standpoint of the ratio of dust generation, therefore, the amount of the concentrate to be forwarded through the concentrate burner 4 and treated has its own upper limit.

(4) The inside of the reaction shaft 5 has an oxidizing atmosphere. Particularly the low-temperature zone in which the powdery raw material blown in through the concentrate burner 4 has not yet attained sufficient temperature elevation is liable to form magnetite. This magnetite throws many hindrances in the way of furnace operation. For example, the magnetite increases the viscosity of the slag to the extent of impairing separation of the slag from the matte and increasing the copper content of the slag. Further since the magnetic has a high density, it settles and accumulates on the hearth and raises the surface level of the hearth and decreases the available furnace internal volume. Moreover, the magnetite combines itself with other oxides such as $Cr_2O_3$ and gives rise to a high viscosity slag in the intermediate layer between the matte and the slag and, consequently, interferes with the separation between the matte and the slag. This high viscosity slag has a high melting point. The high melting point coupled with the high viscosity renders the release of the slag through the slag discharge outlet difficult.

SUMMARY OF THE INVENTION

For the solution to the drawbacks suffered by the conventional flash furnace as described above, this invention aims to provide a method for the operation of a flash smelting furnace which enables the existing flash furnace to treat an increased amount of concentrate without requiring any addition to the size of the furnace and enables the flash furnace to provide an efficient treatment to the incombustible raw materials such as recycling dust and miscellaneous copper which have far lower copper contents than the concentrate under treatment and have undergone the oxidation reaction to an advanced degree.

The other objects and characteristic features of this invention will become apparent from the further disclosure of the invention to be given hereinbelow with reference to the accompanying drawings.

DETAILED DESCRIPTION OF THE INVENTION

The objects of the present invention described above are accomplished by a method for the operation of a flash smelting furnace provided with a reaction shaft, a concentrate burner disposed at the top of the reaction shaft, a settler disposed with one end thereof connected to the lower part of the reaction shaft, an uptake disposed as connected to the other end of the settler, and at least one lance pipe disposed through the ceiling of the settler between the reaction shaft and the uptake and adapted to permit forced supply of at least powdery raw materials and a reaction gas into the melt in the settler, which method comprises blowing the powdery raw materials containing only a small amount of incombustible substances and the reaction gas into the reaction shaft through the concentrate burner, blowing the powdery raw materials containing at least the incombustible substances through the lance pipe, and employing means capable of at least retaining the heat of the melt.

The construction of the flash smelting furnace to be used in working the method of this invention will be described below with reference to FIG. 1.

Figure 1:
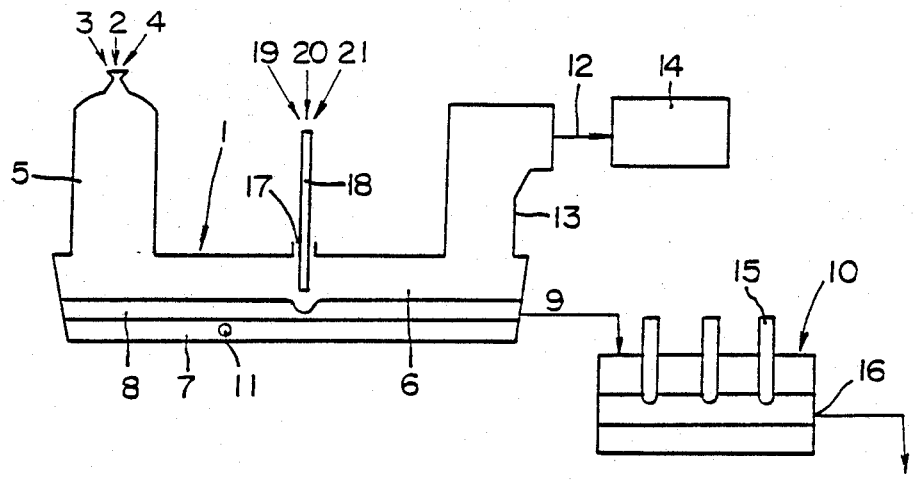
FIG. 1 is an explanatory diagram of a flash smelting furnace to be used in working the method of the present invention.
Figure 2:
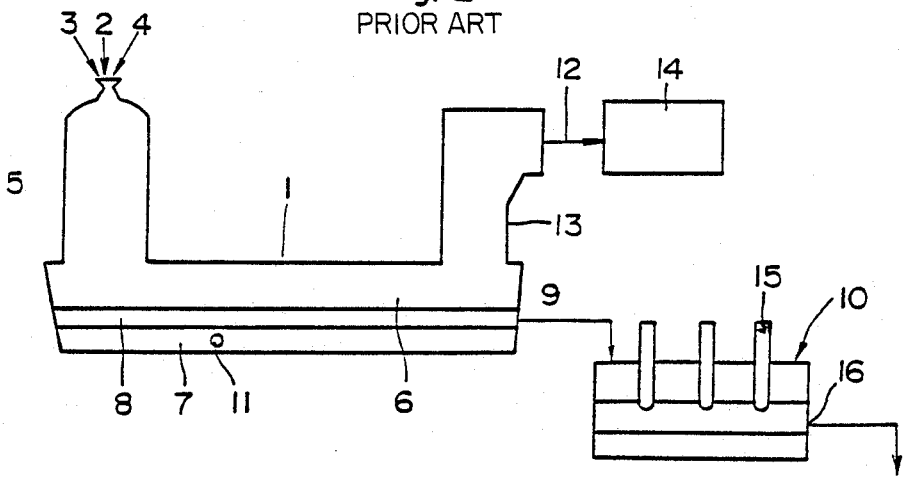
Fig. 2 PRIOR ART
FIG. 2 is an explanatory diagram of the conventional flash smelting furance.

The construction of FIG. 1 is identical with the conventional construction shown in FIG. 2 in the sense that it comprises a reaction shaft provided with a concentrate burner 4, a settler 6, and an uptake 13. The settler 6 is provided in the ceiling thereof with a through hole 17 for insertion of a lance pipe 18. Through this through hole 17, the lance pipe 18 is inserted in such a manner that powdery raw materials 19, a reaction gas 20, and optionally supplemental fuel 21 may be blown into the melt consisting of slag 8 and matte 7 and stored inside the settler 6. One lance pipe 18 or a plurality of such lance pipes 18 may be used, depending on the amount of the powdery raw materials supplied through the settler 6. This lance pipe 18 is adapted so that it will gradually descend as the leading end thereof is worn out by use.

In the flash smelting furnace of this construction, the powdery raw materials such as concentrate, recycling dust, miscellaneous copper, and flux which are supplied to the reaction shaft 5 react with the reaction gas 3 and melt themselves. In the settler, the resultant melt is divided by virtue of difference in specific gravity into slag 8 and matte 7. The waste gas generated in the reaction shaft 5 is passed through the empty space of the settler 6 and an uptake 13 and forwarded to a boiler 14.

In the meantime, through the lance pipe 18 piercing the through hole 17 in the ceiling of the settler 6, the powdery raw materials 19 consisting of concentrate, recycled dust, miscellaneous copper, and flux, the reaction gas 20 such as air or oxygen-enriched air for reaction, and optionally the supplemental fuel 21 are blown into the melt in the settler 6. The powdery raw materials thus introduced quickly enter the melt, react therewith, and melt. The waste gas generated herein is discharged through the uptake in combination with the waste gas which is generated in the reaction shaft 5.

The flash smelting furnace to be used in working the method of this invention uses the so-called bath smelting process and the flash smelting process jointly in one same furnace. The flash smelting method consists in burning the concentrate in suspension and melting the concentrate and other a raw materials by making use of the heat of oxidation. It suffers from the drawbacks mentioned above. Particularly when the incombustible raw materials are used as mixed with the concentrate, the heat of decomposition and the endothermic reaction which ensue will interfere with the combustion and oxidation of the concentrate. As a result, the ratio of dust generation is increased and the formation of an intermediate layer with high viscosity between the matte and the slag occurs.

The bath smelting process has an advantage that the raw materials excel in reactivity and solubility because the powdery raw materials are directly blown into the melt. Since the blowing causes a splash and a vigorous stirring of the melt, the refractory bricks are seriously damaged. For the protection of the refractory bricks against the damage, the furnace proper must be formed in a water-cooling construction. Thus, the loss of heat from the furnace proper owing to the bath smelting process is fairly large as compared with the flash smelting process. Further in the bath smelting process, the blowing of the raw materials into the melt cannot be started until the melt is allowed to accumulate to a certain level. Thus, this process must inevitably rely for the preparation of a seed bath on such an inefficient means as a reverberatory furnace. The furnace to be used in working the method of this invention, therefore, may well be recognized as an effective furnace capable of making up for the drawbacks of the two processes.

In the flash smelting furnace embodying the present invention, the ability of this furnace to melt the concentrate can be increased notably by causing the same powdery raw materials as those contained recycling dust and miscellaneous copper and supplied to the concentrate burner to be blown in through the lance pipe disposed in part of the settler.

In this case, the amount of the powdery raw materials to be supplied through the concentrate burner is so fixed that the thermal load, the space-density and distribution of concentrate, and the flow rate of gas within the reaction shaft will be optimized and only the proportion of the raw materials meant for additional treatment is supplied via the lance pipe.

The operating conditions of the concentrate burner are not effected at all by the reaction in which the raw materials supplied through the lance pipe undergo in the settler. It, therefore, suffices to control these operating conditions as generally practiced to date. The powdery raw materials to be supplied through the lance pipe, when necessary, may incorporate in advance therein the flux similarly to the powdery raw materials supplied through the concentrate burner. The particle size, the moisture, etc., of the powdery raw materials are only required to be such that they will avoid blocking up or adhering to the interior of the lance pipe or the interior of the flow pipe leading to the lance pipe. For practical purpose, it is convenient to use a portion separated from the powdery raw materials formulated and dried for supply to the concentrate burner. The amount of the reaction gas such as air or oxygen-enriched air to be blown in through the lance pipe is fixed so that the introduced reaction gas will give an oxygen supply necessary for the powdery raw materials blown in through the lance pipe will form matte of the quality aimed at. The oxidation of the concentrate is an exothermic reaction. The heat balance in the settler, therefore, can be maintained by suitably setting the ratio of oxygen enrichment of the feed gas without increasing the amount of the supplemental fuel to be used in the settler. When no oxygen enrichment is involved, the auxiliary burner may be used for supply of heat to the lance pipe in the vicinity thereof.

When the flash smelting furnace uses the lance pipe disposed in the settler, the speed of gas at the outlet of the lance pipe is fixed in respect to the forced introduction of the raw materials and the reaction gas into the bath, the stirring of the bath, and the collection of the dust generated by the splash in the waste gas of the reaction shaft. For practical purposes, it is desired to fall approximately in the range of 50 to 150 m/s.

An experiment was conducted using a small flash smelting furnace having a design concentrate smelting capacity of 0.8 T/H (a cylindrical furnace having a diameter of 1.5 m inside the brick lining of a reaction shaft, a height of 3.5 m from the surface of the melt in a settler to the ceiling of the reaction shaft, a diameter of 1.5 m inside the brick lining of the settler, and a length of 5.25 m of the furnace) and blowing prescribed powdery raw materials through a concentrate burner and a lance pipe. The results of this experiment were as indicated below. Dust-free powdery raw materials prepared by mixing 100 parts by weight of copper concentrate containing 30.4% of Cu, 27.0% of Fe, 31.8% of S, and 4.58% of $SiO_2$ (each by weight) with 12 parts by weight of silica ore containing 85% by weight of $SiO_2$ and drying the resultant mixture to a water content of not more than 0.2% were blown at a rate of 0.8 T/H, oxygen-enriched air having an oxygen concentration of 40% and preheated to 350° C. at a rate of 400 $Nm^3/H$, and heavy oil as a supplemental fuel at a rate of 23 1/H respectively into the reaction shaft through the concentrate burner. Meanwhile, the aforementioned powdery raw materials were blown through the lance pipe into the melt in the settler at a varying rate of 0, 0.2, 0.4, and 0.6T/H, in combination with oxygen-enriched air having an oxygen concentration of 50% and kept at room temperature and fed at a rate proportionate to the amount of the powdery raw materials used. The top of the lance was set 0.6 m above the bath surface. The diameter of the lance was suitably varied so that the speed of gas at the outlet of the lance would invariably fall in the range of 60 to 70 m/s. To make up for the loss of heat caused by radiation from the settler, two heavy oil burners were used to burn heavy oil at a rate of 70 1/H. The relations between the amount of the powdery raw materials blown in through the lance pipe and the ratio of dust generation, the difference of temperature between matte and slag, and the unit ratio of heavy oil are shown in FIGS. 3(*a*) and 3(*b*).

Figure 3:
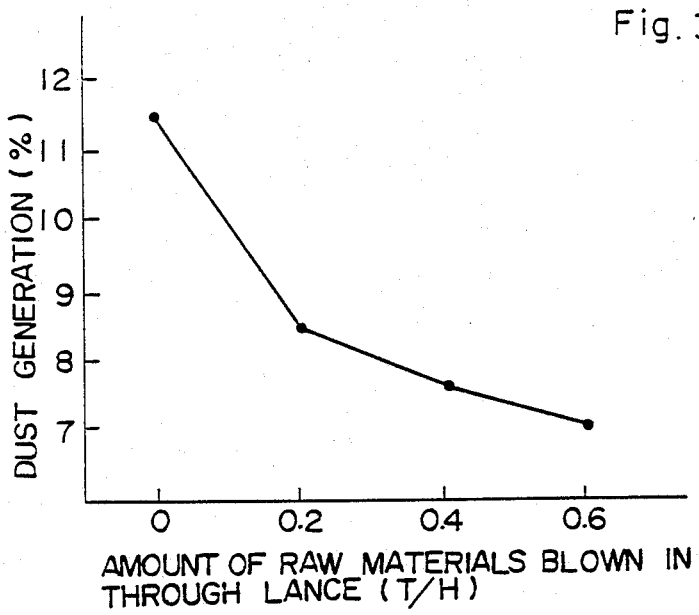
FIG. 3 (*a*), (*b*), and (*c*) are diagrams showing the data obtained with respect to the operation of the flash smelting furnace used in working the method of this invention, supplying fixed powdery raw materials through a concentrate burner and a lance pipe of the furnace, specifically the relations between the amount of the raw materials supplied through the lance pipe and the particulars displayed as the results of the operation.
Figure 3:
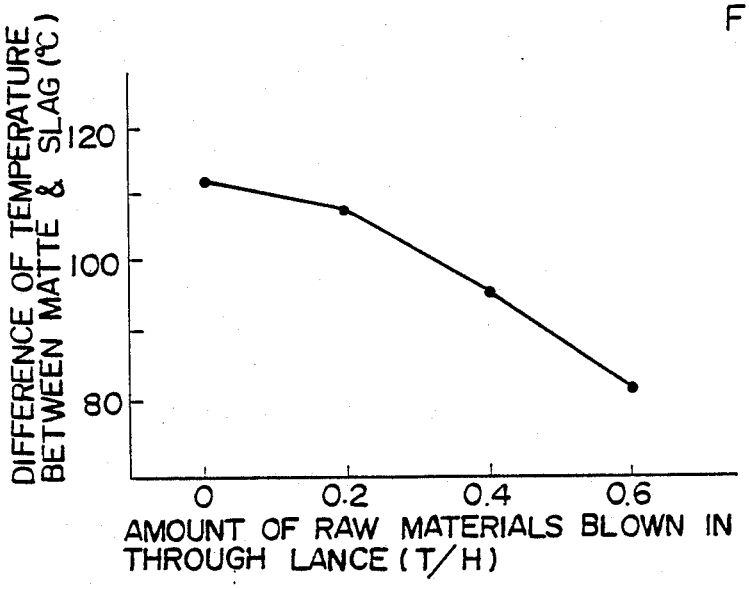
Figure 3C:
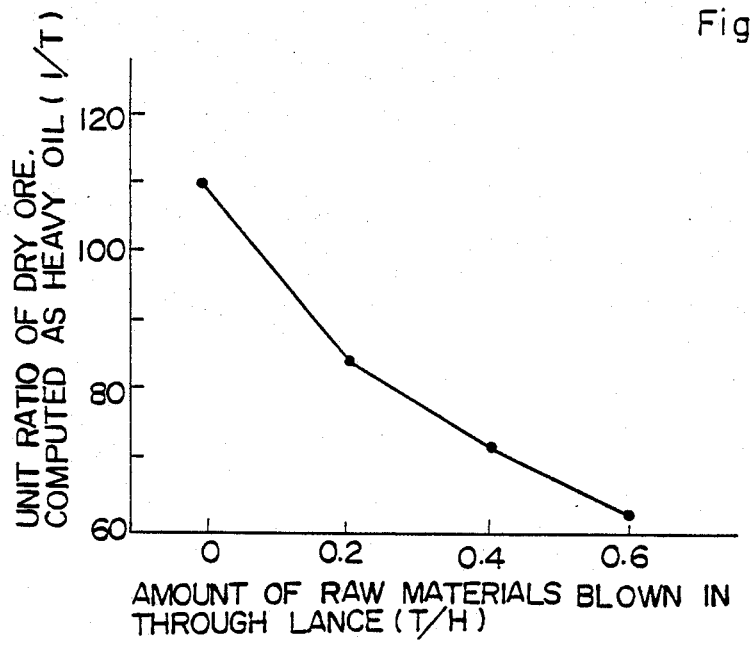

It is noted from FIG. 3 (*a*) that the ratio of dust generation (in % relative to the amount of the powdery raw materials treated) decreased in proportion to the amount of the raw materials blown in through the lance pipe. Then as shown in FIG. 3 (*b*), the temperature of the slag was over 110° C. higher than that of the matte where the raw materials through the lance was not blown. This temperature difference, which is desired to be as small as possible, decreased to about 80° C. as the amount of the raw materials blown in through the lance increased. This behavior of the temperature difference indicates that the melt in the settler was homogenized more thoroughly as the bath was stirred by the current of the raw materials blown in through the lance. Since the auxiliary fuel used in the settler required no increase in amount when the oxygen concentration in the gas blown in through the lance was 50%, the unit ratio of the heavy oil consumed in the entire furnace decreased in proportion as the amount of the raw materials blown in through the lance increased as shown in FIG. 3 (*c*).

The amount of the raw materials blown in through the lance pipe depended, though not exclusively, on the size of the settler. In the case of the small flash smelting furnace used in the experiment, no special problem occurred even when the amount of the raw materials supplied through the lance was 0.6 T/H while that of the powdery raw materials supplied through the concentrate burner was 0.8 T/H.

In the method of this invention, such drawbacks as described in (2) above with respect to the conventional technique are encountered particularly when, as the powdery raw materials to be supplied to the flash furnace, such incombustible substances as recycling dust and miscellaneous copper which contain a copper component worthy of recovery and yet has a low sulfur content or which has undergone oxidization to an advanced stage such as to induce little or no exothermic reaction on contact with oxygen are supplied exclusively through the concentrate burner. The method of this invention avoids these drawbacks by supplying the incombustible substances preferentially through the lance pipe instead of causing the incombustible substances to be actively incorporated in the powdery raw materials supplied via the concentrate burner and further by supplying the concentrate meant for increased treatment in combination with the aforementioned incombustible substances. The flux and the reaction gas which are required for the dust, the residual copper, and the concentrate supplied through the lance pipe may be introduced via the lance pipe as well. The auxiliary fuel, when necessary, may be supplied likewise.

When the incombustible substances such as recycling dust and miscellaneous copper cannot be treated solely by the lance pipe in spite of due respect paid to the number of lance pipes and the diameter of lance pipe, part of such incombustible substances may be supplied through the concentrate burner. Though this modification of the method of this invention more or less impairs the effect of this invention, it is embraced in the present invention.

When the incombustible substances such as recycling dust and miscellaneous copper which have heretofore been treated in the concentrate burner according to the conventional method are treated via the lance pipe, it suffices to operate the concentrate burner by using the flux, the auxiliary fuel, and the reaction gas in amounts less the respective amounts required for the treatment of the portion of the incombustible substance exceeding the capacity of the lance pipe. Since the incombustible substances generally call for a notably large amount of the auxiliary fuel as compared with the concentrate, the thermal load within the reaction shaft is remarkably lessened by ceasing the supply of the incombustible substances through the concentrate burner.

When the incombustible substances alone are supplied through the lance pipe, a special means of heat compensation is required because the supplied incombustible substances entail no exothermal treatment or generate heat sparingly unlike the concentrate.

As the means for heat compensation, any of the following methods may be employed:

(1) A method with effects the heat compensation by the combustion of the auxiliary fuel directly below the lance pipe by the use of a burner inserted into the settler through the lateral wall thereof. The incombustible substances for supply through the lance pipe are blown in jointly with air or neutral gas for fluid conveyance. To minimize the change of the matte in quality or the loss of heat due to release of the waste gas, the amount of gas for this fluid conveyance is desired to be decreased to the fullest possible extent. In this case, since the operation of the furnace which is easy to perform is deficient in thermal efficiency, the amount of the auxiliary fuel cannot be expected to be decreased so remarkably as in the case where the incombustible substances are treated in the concentrate burner. (2) A method which effects the heat compensation by using the heat of reaction generated during partial oxidation of the matte in the settler with the oxygen from the air or oxygen-enriched air supplied through the lance pipe in combination with the incombustible substances. The amount of oxygen to be supplied is such as to satisfy oxygen supply required for the oxidation of the incombustible substances and further induce oxidation of the matte enough for generation of the heat to be required. In this case, since the matte produced in the settler acquires improved quality, the operation of the concentrate burner must be controlled so that the matte produced on the concentrate burner side will acquire lower copper grade than is finally aimed at. For this purpose, the forced introduction of the reaction gas through the lance is suspended temporarily and the operating conditions of the concentrate burner must be altered each time such temporary suspension of the supply of the reaction gas is made. Thus, this method proves to be complicated. (3) A method which attains the heat compensation by blowing the incombustible substances in combination with the auxiliary fuel and the air or oxygen-enriched air for the combustion of the fuel through the lance pipe. Since the combustion of the auxiliary fuel takes place in the bath held in the settler, this method enjoys a high thermal efficiency and economic use of the auxiliary fuel as compared with the method of (1) described above or the treatment in the concentrate burner. The auxiliary fuel to be used in this method may be of a gaseous, liquid, or solid type. Since the atmosphere encircling the lance can be freely controlled to an oxidative or reductive condition by suitably changing the air ratio, the operation of the lance pipe can be adapted for incombustible substances to be supplied. When residual copper having a high metal content is used as an incombustible substance, for example, it suffices to adjust the atmosphere to a neutral state by fixing the air ratio at 1. When the recycling dust having a high oxide content is to be treated, it suffices to adjust the atmosphere to a reductive state by lowering the air ratio.

The methods of (1) to (3) described above may be employed either singly or in a combined manner. For example, part of the heat required may be obtained by the burner disposed on the lateral wall of the settler and the balance may be filled by the method of (2) or (3).

Now, the results of the experiment conducted by using a small test furnace possessing a design concentrate dissolving capacity of 0.8 T/H and blowing a finely divived residual copper at a rate of 0.2 T/H under varying conditions through a lance pipe will be described below. A concentrate burner of this furance was operated under the same conditions as those used for the aforementioned experiment conducted on a small test furnace (concentrate + flux →0.8 T/H). The operating conditions and the results of the experiment are shown in Table 1.

TABLE 1

Figure 4A:
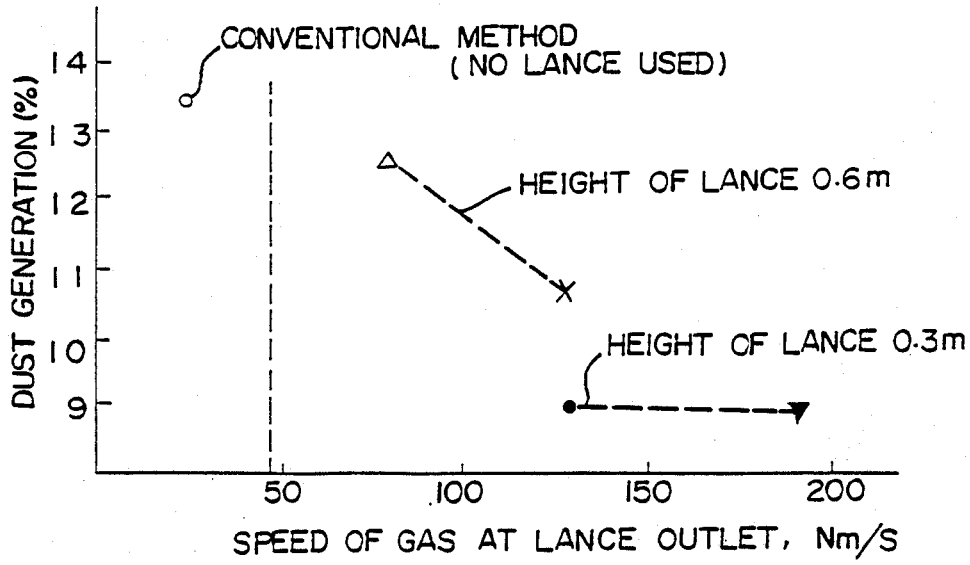
FIG. 4 (*a*), (*b*), and (*c*) are diagrams showing the data obtained with respect to an operation by the method of this invention blowing residual copper through a lance pipe of the flash smelting furnace, specifically the relations between the speed of the gas at the outlet of the lance pipe and the particulars displayed as the result of the operation.
Figure 4B:
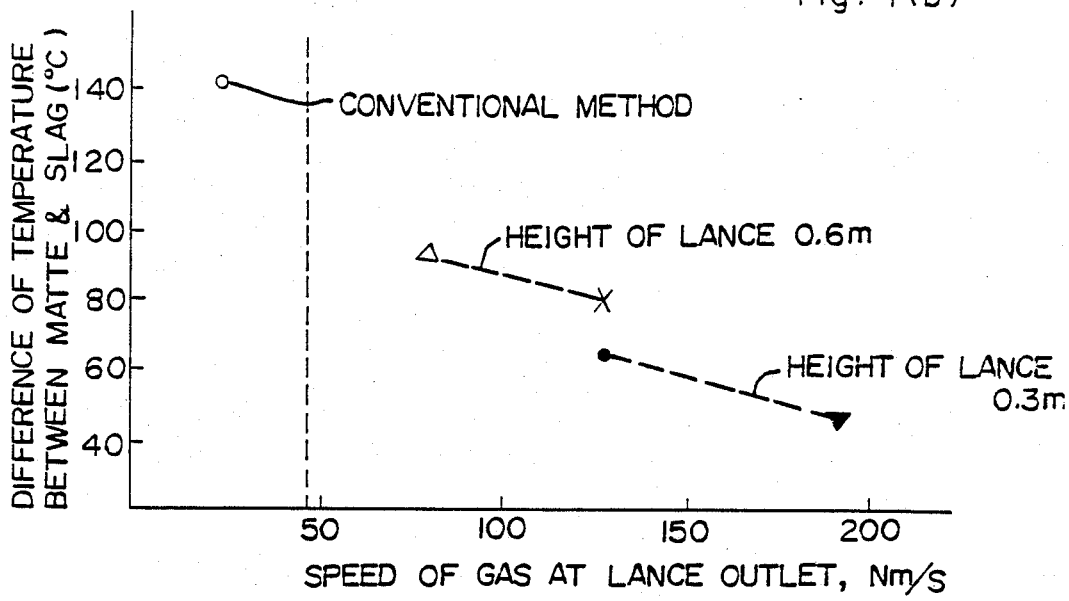
Figure 4C:
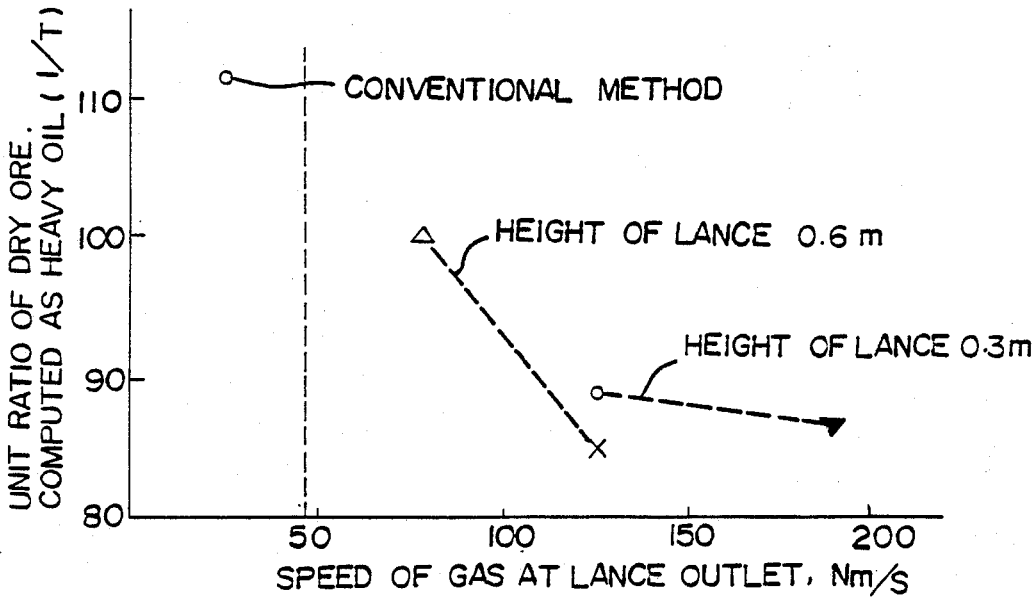

| | | Run No. 1 | 2 | 3 | 4 | 5 |
|---|---|---|---|---|---|---|
| Operating conditons | Method of miscellaneous copper supply | Concentrate burner | Lance pipe | | | |
| | Gas supplied through lance | | | | | |
| | Oxygen concentration, % | — | 21 | 32 | 32 | 21 |
| | Volume, $Nm^3/H$ | — | 60 | 94 | 94 | 142 |
| | Height of lance, m | — | 0.6 | 0.6 | 0.3 | 0.3 |
| | Speed of gas at outlet of lance, Nm/S | — | 82 | 128 | 128 | 194 |
| | Method of heat compensation | | ① | ③ | ③ | ③ |
| | Amount of pulverized coal supplied as fuel through lance, kg/H | | | | | |
| Results | Ratio of dust generation, % | 13 | 12.6 | 10.8 | 9.2 | 9.0 |
| | Temperature difference between matte and slag, °C. | 142 | 94 | 82 | 64 | 45 |
| | Unit ratio of fuel, computed as heavy oil, 1/T | 111 | 101 | 85 | 89 | 87 |
| | Marks of FIG. 4 | ○ | Δ | X | ● | ★ |

The results of Table 1 are graphically indicated in FIG. 4 a, b, and c. From these results, it is clearly noted that the ratio of dust generation was low in any of run Nos. 2 to 5 according with the method of this invention as compared with Run No. 1 effecting the treatment of the residual copper in the concentrate burner and the effect in this respect was conspicuous particularly when the lance was given a small height and the speed of gas at the lance outlet was near or above about 130 Nm/S. The temperature difference between the matte and the slag was notably small when the method of this invention was employed. This difference was particularly small when the speed of gas at the lance outlet was high. The unit ratio of the auxiliary fuel was remarkably small when the pulverized coal was blown in through the lance as in Run Nos. 3–5.

Now, working examples employing the method of the present invention, comparative experiments conducted by performing the furnace operation without use of a settler and a lance, and a referential experiment conducted by blowing incombustible substances and a concentrate in a mixed state through a concentrate burner and a settler-lance will be described below. Referential Experiment 1:

A flash furnace which was provided, similarly to the aforementioned small test furnace, with a concentrate burner disposed at the top of a reaction shaft and a lance pipe inserted through the ceiling between the reaction shaft and a waste gas outlet into the settler was operated for four days under varying conditions indicated in Table 2, using a dry ore made up of 79.1 parts by weight of copper concentrate containing 30.4% of Cu, 27.0% of Fe, 31.8% of S, and 4.6% of $SiO_2$ each by weight, 9.3 parts by weight of a flux having a $SiO_2$ content of 85% by weight, and 11.6 parts by weight of repeating dust containing 20.5% of Cu, 13.1% of Fe, 9.4% of S, and 6.9% of $SiO_2$ each by weight. The results are shown in Table 2.

COMPARATIVE EXPERIMENT 1:

The same furnace with the settler and the lance kept in an inoperative state was operated for four days, supplying the same dry ore as used in Referential Experiment 1 exclusively through the concentrate burner. The operating conditions and the results are shown in Table 2.

Table 2 compares the performance of the flash furnace provided in a settler with a lance pipe and used in working the method of the present invention with the performance of the flash furnace keeping the lance pipe unused, to demonstrate the effect brought about by the use of the lance pipe in increasing the amount of treatment.

TABLE 2

| | | | Referential Experiment 1 | Comparative Experiment 1 |
|---|---|---|---|---|
| Operating conditions | Concentrate burner | Amount of dry ore treated, T/H | 0.87 | 0.86 |
| | | Concentrate, T/H | 0.69 | 0.68 |
| | | Flux, T/H | 0.08 | 0.08 |
| | | Dust, T/H | 0.10 | 0.10 |
| | | Amount of heavy oil used, 1/H | 30.0 | 30.0 |
| | | Amount of gas supplied, $Nm^3/H$ | 440 | 440 |
| | | Temperature of gas supplied, °C. | 350 | 350 |
| | | Oxygen content of air supplied, % | 40 | 40 |
| | Settler-lance | Heavy oil as auxiliary fuel for settler, 1/H | 68.1 | 70.2 |
| | | Amount of dry ore blown in, T/H | 0.56 | — |
| | | Concentrate, T/H | 0.44 | — |
| | | Flux, T/H | 0.05 | — |
| | | Dust, T/H | 0.07 | — |
| | | Amount of gas blown in, $Nm^3/H$ | 217 | — |
| | | Oxygen content of gas blown in, % | 51.5 | — |
| | | Speed of gas at lance outlet, Nm/S | 60.3 | — |
| | | Height of lance, m | 0.6 | — |
| | Results | Unit ratio of heavy oil, 1/T | 68.6 | 116.5 |
| | | Temperature difference betwen matte and slag, °C. | 82 | 112 |
| | | Ratio of dust generation, % | 8.0 | 12.5 |

TABLE 2-continued

| | Referential Experiment 1 | Comparative Experiment 1 |
|---|---|---|
| Cu content of matte, % | 60.1 | 60.3 |

It is clearly noted from the results of Table 2 that the unit ratio of fuel could be notably lowered and the ratio of dust generation could also be notably decreased because the concentrate burner treated the dry ore as the raw material under the same operating conditions as those employed heretofore and the settler effected further solution of the dry ore without specifically increasing the amount of an auxiliary fuel in the settler.

EXAMPLE 1

The same flash furnace as used in Referential Experiment 1 was operated for four days, supplying only the copper concentrate of the aforementioned composition and the flux through the concentrate burner without supplying such incombustible substances as recycled dust and blowing the dust of the aforementioned composition, the residual copper containing 32.8% of Cu, 6.2% of Fe, 3.2% of S, and 17.7% of $SiO_2$, and finely divided coal through the settler-lance.

COMPARATIVE EXPERIMENT 2

The same furnace as used in Referential Experiment 1 was operated with the settler-lance kept in an inoperative state for four days, supplying the concentrate, the dust of the same composition as that of Example 1 except for flux, and the residual copper in a mixed state through the concentrate burner.

The operating conditions used and the results obtained in Example 1 and Comparative Experiment 2 are shown in Table 3.

TABLE 3

| | | | Example 1 | Comparative Experiment 1 |
|---|---|---|---|---|
| Operating Conditions | Concentrate burner | Amount of dry ore treated, T/H | 0.74 | 0.94 |
| | | Concentrate, T/H | 0.66 | 0.52 |
| | | Flux, T/H | 0.08 | 0.06 |
| | | Dust, T/H | — | 0.14 |
| | | Miscellaneous copper | — | 0.22 |
| | | Amount of heavy oil used, 1/H | 25.0 | 42.4 |
| | | Amount of gas supplied, $Nm^3/H$ | 450 | 510 |
| | | Temperature of gas supplied, °C. | 350 | 350 |
| | | Oxygen content of gas supplied, % | 40 | 40 |
| | Settler-lance | Heavy oil as auxiliary fuel for settler, 1/H | 50.0 | 70.0 |
| | | Amount of dry ore blown in, T/H | 0.324 | — |
| | | Dust, T/H | 0.09 | — |
| | | Miscellaneous copper | 0.20 | — |
| | | Pulverized coal | 0.034 | — |
| | | Amount of gas blown in, $Nm^3/H$ | 123 | — |
| | | Oxygen content of gas blown in, % | 32 | — |
| | | Speed of gas at lance outlet, Nm/S | 193 | — |
| | | Height of lance, m | 0.3 | |
| | Results | Unit ratio of heavy oil, 1/T | 93.4* | 119.6 |
| | | Temperature difference between matte and slag, °C. | 67 | 142 |
| | | Ratio of dust generation, % | 9.11 | 14.5 |
| | | Cu content of matte, % | 60.1 | 58.1 |

*For conversion of the amount of coal to that of heavy oil was effected, based on the equation: 1.6 kg of coal = 1 lit of heavy oil It is clearly noted from the results of Table 3 that the method which comprised blowing the total amount of incombustible substances for supply to the furnace through the lance pipe notably decreased the unit ratio of fuel, the temperature difference between the matte and the slag, and the ratio of dust generation (relative to the ore supplied to the furnace) as compared with the method which comprised supplying the incombustible substances through the concentrate burner.

EXAMPLE 2

The same flash furnace as used in Referential Experiment 1 was operated for four days, supplying only the copper concentrate and the flux through the concentrate burner and blowing the entire amount of the dust expected to be recycled within the furnace and the pulverized coal through the settler-lance.

EXAMPLE 3

The same flash furnace as used in Referential Experiment 1 was operated for four days, supplying only the copper concentrate and the flux through the concentrate burner and flowing the dust in an amount larger than the dust generated as an incombustible substance, a small amount of concentrated ore, and the flux through the settler-lance.

EXAMPLE 4

The same flash furnace as used in Referential Experiment 1 was operated for four days, using the same powdered raw materials for supply to the concentrate burner and feeding the fuel and the gas under the same conditions as in Example 3, and blowing the dust in the same amount as the dust generated as an incombustible substance and the residual copper and the concentrated ore and the flux both in increased amounts through the settler-lance. The operating conditions used and the results obtained in Examples 2–4 are shown in Tables 4.

TABLE 4

| | | | Example 2 | Example 3 | Example 4 |
|---|---|---|---|---|---|
| Operating conditons | Concentrate burner | Amount of dry ore treated, T/H | 0.87 | 0.92 | 0.92 |
| | | Concentrate, T/H | 0.78 | 0.82 | 0.82 |
| | | Flux, T/H | 0.09 | 0.10 | 0.10 |
| | | Amount of heavy oil used, l/H | 22.0 | 23.0 | 23.0 |
| | | Amount of gas supplied, $Nm^3/H$ | 400 | 405 | 405 |
| | | Temperature of gas supplied, °C. | 350 | 350 | 350 |
| | | Oxygen content of gas supplied, % | 40 | 40 | 40 |
| | Settler-lance | Heavy oil as auxiliary fuel for settler, l/H | 60.0 | 70.0 | 70.0 |
| | | Amount of dry ore blown in, T/H | 0.104 | 0.30 | 0.60 |
| | | Concentrate, T/H | — | 0.09 | 0.33 |
| | | Flux, T/H | — | 0.01 | 0.04 |
| | | Dust, T/H | 0.09 | 0.20 | 0.13 |
| | | Miscellaneous copper | — | — | 0.10 |
| | | Pulverized coal | 0.014 | — | — |
| | | Amount of gas blown in, $Nm^3/H$ | 55 | 75 | 120 |
| | | Oxygen content of gas blown in, % | 30 | 44 | 55 |
| | | Speed of gas at lance outet, Nm/S | 192 | 120 | 163.4 |
| | | Height of lance, m | 0.3 | 0.3 | 0.3 |
| | Results | Unit ratio of heavy oil, l/T | 94.5* | 90.3 | 61.2 |
| | | Temperature difference between matte and slag, °C. | 91 | 67 | 58 |
| | | Ratio of dust generation, % | 9.8 | 10.7 | 8.5 |
| | | Cu content of matte, % | 61.0 | 64.0 | 60.4 |

*For conversion of the amount of coal to that of heavy oil was effected, based on the equation: 1.6 kg of coal = 1 l of heavy oil From the results given above, it is noted that in Example 2, increased treatment of the concentrated ore in the concentrate burner was realized and the effect in lowering the unit ratio of fuel and the ratio of dust generation was conspicuous as compared with Comparative Experiment 1 because the incombustible substances were treated in the settler-lance and not in the concentrate burner. In Example 3, increased treatment of the incombustible substances was realized also in the settler-lance and the ratio of dust generation was low as compared with Comparative Experiment 1. Then, in Example 4, the amount of treatment realized in the settler-lance was not less than 60% of the amount of treatment obtained in the concentrate burner and, in spite of such increased amount of treatment as mentioned above, the ratio of dust generation was low, the unit ratio of fuel was notably low, and the temperature difference between the matte and the slag was markedly small.

The method of this invention for the operation of a flash smelting furnace permits a generous addition to the ability of the furnace to dissolve the concentrate as compared with the conventional method for the operation of a flash furnace because the powdery raw materials in the same amount as in the conventional flash furnace can be forwarded through the concentrate burner and melted in the reaction shaft and, at the same time, the concentrated ore and the incombustible substances can be melted through the lance pipe. In this case, the reaction shaft can be operated under the optimum conditions because the condition of reaction of the ore within the reaction shaft is not affected by the lance pipe used in the settler.

While the waste gas containing a large amount of the dust generated in the reaction shaft is passing through the empty space of the settler, it advances through the splash of the melt caused by the forced current of the reaction gas introduced through the lance pipe and part of the dust is mechanically caught by the drops of the splashed melt. Thus, the waste gas departing from the uptake has a lowered dust content and, as the result, dust troubles otherwise caused in the uptake, the boiler, and the interconnecting part are lessened.

What is claimed is:

1. A method of producing a copper or nickel-containing matte from a powdered concentrate which contains a copper or nickel sulfide ore in an apparatus which includes a vertical reaction shaft that has a concentrate burner at an upper end thereof and forms a lower end, a horizontal settler which is connected at a first end thereof to a said lower end of said reaction shaft and has a ceiling and a second end, and an uptake shaft connected to said second end of said settler, said method comprising the steps of (a) blowing a reaction gas and a powdery raw material which includes said powdered concentrate through said concentrate burner so that said powdered concentrate will react with said reaction gas as said powdered concentrate descends within said reaction shaft, thereby providing in said settler a lower liquid layer of copper or nickel-containing matte, an upper liquid layer of slag and a hot waste gas containing dust, (b) providing at least one downwardly-extending lance pipe in said ceiling of said settler, (c) jointly blowing said powdered concentrate, recycled dust, powdery auxiliary fuel and a reaction gas through each lance pipe at a speed of 50 to 150 m/s and into said slag layer in said settler, thereby providing additional slag, copper or nickel-containing matte and hot waste gas, (d) removing said hot waste gas from said settler through said uptake shaft, (e) recovering said dust from said hot waste gas, and (f) recycling at least some of said recovered dust for use in step (c).

2. A method according to claim 1, wherein said reaction gas in steps (a) and (c) consists of hot air.

3. A method according to claim 1, wherein said reaction gas in steps (a) and (c) consists of oxygen-enriched air.

4. A method according to claim 1, wherein said powdery raw material in step (a) includes recycled dust from step (f) and a flux.

* * * * *